US012594471B2

(12) United States Patent
Bohannon

(10) Patent No.: US 12,594,471 B2
(45) Date of Patent: Apr. 7, 2026

(54) GOLF BAGS AND SIMILAR HAVING SELECTIVELY MOVABLE STRAPS

(71) Applicant: FROGGER, LLC, Bend, OR (US)

(72) Inventor: Jeremiah Bohannon, Bend, OR (US)

(73) Assignee: FROGGER, LLC, Bend, OR (US)

( * ) Notice: Subject to any disclaimer, the term of this patent is extended or adjusted under 35 U.S.C. 154(b) by 61 days.

(21) Appl. No.: 18/833,343

(22) PCT Filed: Feb. 10, 2023

(86) PCT No.: PCT/IB2023/051216

§ 371 (c)(1),
(2) Date: Jul. 25, 2024

(87) PCT Pub. No.: WO2023/152703

PCT Pub. Date: Aug. 17, 2023

(65) Prior Publication Data

US 2025/0161770 A1 May 22, 2025
US 2026/0054141 A9 Feb. 26, 2026

Related U.S. Application Data

(60) Provisional application No. 63/267,908, filed on Feb. 11, 2022.

(51) Int. Cl.
*A45F 3/04* (2006.01)
*A63B 55/00* (2015.01)
*A63B 55/40* (2015.01)

(52) U.S. Cl.
CPC ..... *A63B 55/408* (2015.10); *A63B 55/40* (2015.10)

(58) Field of Classification Search
CPC ..... A45F 3/04; A45F 3/02; A45F 3/14; A45F 2003/142; A45F 3/047; A63B 55/00;
(Continued)

(56) References Cited

U.S. PATENT DOCUMENTS 3,406,433 A * 10/1968 Frey ..... B60R 22/18 24/647
4,667,820 A 5/1987 Solheim
(Continued)

FOREIGN PATENT DOCUMENTS

GB 281170 A * 12/1927 ..... A47B 57/045

OTHER PUBLICATIONS

International Search Report and Written Opinion dated May 16, 2023 for PCT Patent Application No. PCT/IB2023/051216.
(Continued)

*Primary Examiner* — Adam J Waggenspack
(74) *Attorney, Agent, or Firm* — NorthStar Law Group

(57) ABSTRACT

A golf bag (and/or other types of bags, carriers, storage containers, and the like) can be outfitted with a shoulder strap configured for relatively easy grasping when the bag is set down in a substantially prone position, e.g., such that a user would not need to bend down significantly to pick up the bag. Moreover, the shoulder strap may be moveable—e.g., pivoting about a hinge—when the bag is being carried, for comfort and convenience. To this end, the bag may include a locking hinge that establishes a selectively pivotable engagement between the shoulder strap and the bag. Specifically, in a prone position, the hinge may releasably lock the shoulder strap in an upright position for easy grasping, and when lifted, the hinge may allow pivoting for relatively easy carrying. The hinge may also or instead include features that promote collapsing of the shoulder strap for storage.

20 Claims, 8 Drawing Sheets

(58) Field of Classification Search
CPC ..... A63B 55/40; A63B 55/408; A63B 55/50; A63B 55/57; A63B 55/53; Y10T 24/45696
See application file for complete search history.

(56) References Cited

U.S. PATENT DOCUMENTS

| | | | | |
|---|---|---|---|---|
| 4,834,235 | A | 5/1989 | Solheim et al. | |
| 5,038,984 | A | 8/1991 | Izzo | |
| 5,437,365 | A | 8/1995 | Solheim | |
| 5,501,328 | A | 3/1996 | Keller et al. | |
| 5,636,778 | A | 6/1997 | Jones et al. | |
| 5,954,255 | A | 9/1999 | Beebe et al. | |
| 5,996,789 | A | 12/1999 | Suggs et al. | |
| 6,006,974 | A * | 12/1999 | Varney | A63B 55/408 224/259 |
| 6,296,116 | B1 | 10/2001 | Schmidt et al. | |
| 6,375,004 | B1 | 4/2002 | Tuerschmann et al. | |
| 6,415,919 | B1 | 7/2002 | Keller | |
| 6,460,747 | B1 | 10/2002 | Tuerschmann et al. | |
| 6,478,151 | B1 | 11/2002 | Schmidt et al. | |
| 6,488,191 | B1 * | 12/2002 | Suggs | A63B 55/00 224/264 |
| 6,494,320 | B1 | 12/2002 | Schmidt et al. | |
| 6,513,652 | B1 | 2/2003 | Solheim et al. | |
| 6,669,069 | B2 | 12/2003 | Suggs | |
| 6,687,963 | B1 * | 2/2004 | Chang | A45F 3/14 24/579.11 |
| 7,059,504 | B2 | 6/2006 | Suggs | |
| 7,909,215 | B2 | 3/2011 | McGuire et al. | |
| 8,480,507 | B2 | 7/2013 | Finn et al. | |
| 8,517,862 | B2 | 8/2013 | Stites et al. | |
| 8,919,548 | B2 | 12/2014 | McGuire et al. | |
| 9,033,146 | B2 | 5/2015 | Higdon et al. | |
| 9,421,608 | B2 | 8/2016 | Loudenslager et al. | |
| 9,480,892 | B2 | 11/2016 | Loudenslager et al. | |
| 9,533,205 | B2 | 1/2017 | McGuire et al. | |
| 9,538,820 | B2 | 1/2017 | Loudenslager et al. | |
| 10,661,134 | B2 | 5/2020 | Martell et al. | |
| 10,661,135 | B2 | 5/2020 | Eades et al. | |
| 10,716,982 | B2 | 7/2020 | Bruce et al. | |
| 11,077,345 | B2 | 8/2021 | Martell et al. | |
| 11,123,616 | B2 | 9/2021 | Martell et al. | |
| 11,142,163 | B2 * | 10/2021 | Morgan | B60R 22/24 |
| 2006/0186163 | A1 | 8/2006 | Suggs et al. | |
| 2007/0262110 | A1 | 11/2007 | Anderson et al. | |
| 2008/0314942 | A1 | 12/2008 | Tuerschmann | |
| 2009/0152144 | A1 | 6/2009 | Anderson et al. | |
| 2009/0178950 | A1 | 7/2009 | Quartarone et al. | |
| 2010/0072091 | A1 | 3/2010 | Quartarone | |
| 2014/0318998 | A1 | 10/2014 | Loudenslager et al. | |
| 2015/0114859 | A1 | 4/2015 | Loudenslager | |
| 2015/0136825 | A1 | 5/2015 | Kalck et al. | |
| 2020/0215400 | A1 | 7/2020 | Martell et al. | |
| 2020/0353329 | A1 | 11/2020 | Martell et al. | |
| 2020/0376354 | A1 | 12/2020 | Martell | |
| 2021/0101560 | A1 | 4/2021 | Morgan | |

OTHER PUBLICATIONS

Moonlite—Discontinued Model, [site visited Aug. 8, 2024], Available from internet, U R L: https://ping.com/en-us/shop/bags/carry-bags/discontinued/moonlite (Year: 2024).

Snap-Hook Golf, [site visited Aug. 8, 2024]. Available from internet, U R L:https://snaphookzgolf.com/ (Year:2024).

* cited by examiner

GOLF BAGS AND SIMILAR HAVING SELECTIVELY MOVABLE STRAPS

CROSS-REFERENCE TO RELATED APPLICATIONS

This application is a national stage entry application of International Patent Application No. PCT/IB23/51216 filed on Feb. 10, 2023, which claims priority to U.S. Provisional Pat. App. No. 63/267,908 filed on Feb. 11, 2022, where the entire content of which is hereby incorporated by reference.

FIELD

The present disclosure generally relates to devices, systems, and methods related to a bag with a selectively movable strap, and in particular to bags that can be used, by way of example, for storing and carrying golf clubs and the like.

BACKGROUND

Bags and carriers such as golf bags and the like can be set down and picked up many times during their intended use. To this end, many golf bags include integrated stands and the like that can be used to prop-up the bag when it is not being carried, e.g., so that a user does not need to bend down significantly to pick up the bag for carrying and/or moving. However, these stands are often bulky, cumbersome, and prone to failure. Moreover, such stands can be overkill in the context of smaller bags, e.g., accounting for much of the overall weight and/or size of the bag. And while some golf bags may exist that include shoulder straps that are propped-up when set down such that a user does not need to bend down significantly to pick up the bag, these bags can be uncomfortable for carrying and use, e.g., due to the rigidity and/or complexity of these straps.

There remains a need for improved bags and the like.

SUMMARY

A golf bag (and/or other types of bags, carriers, storage containers, and the like) can be outfitted with a shoulder strap configured for relatively easy grasping when the bag is set down in a substantially prone position, e.g., such that a user would not need to bend down significantly to pick up the bag. Moreover, the shoulder strap may be moveable—e.g., pivoting about a hinge—when the bag is being carried, for comfort and convenience. To this end, the bag may include a locking hinge that establishes a selectively pivotable engagement between the shoulder strap and the bag. Specifically, in a prone position, the hinge may releasably lock the shoulder strap in an upright position for easy grasping, and when lifted, the hinge may allow pivoting for relatively easy carrying. The hinge may also or instead include features that promote collapsing of the shoulder strap for storage.

In an aspect, a golf bag disclosed herein may include a housing including a first end defining one or more voids configured to receive one or more golf clubs, a second end opposite the first end, and one or more sidewalls disposed between the first end and the second end. The golf bag may also include a shoulder strap engaged with the housing and structurally configured for placement on or around a shoulder of a user for carrying the golf bag; and a locking hinge establishing selectively pivotable engagement between the shoulder strap and the housing. The locking hinge may include: a slot engaged with the housing, the slot defining a first portion and a second portion; a projection engaged with an end of the shoulder strap, the projection slidable within the slot between a first position when disposed within the first portion and a second position when disposed within the second portion, where, when the projection is in the first position, the strap is pivotable about a first axis relative to the housing, and where, when the projection is in the second position, the strap is mitigated from pivoting about the first axis.

Implementations may include one or more of the following features. When the housing is placed on a substantially horizontal surface such that the shoulder strap opposes the substantially horizontal surface, weight of the shoulder strap may provide a force that moves the projection within the slot from the first position to the second position. In an absence of other forces, the weight of the shoulder strap may maintain the projection in the second position when the housing is placed on the substantially horizontal surface and the shoulder strap opposes the substantially horizontal surface. When the projection is in the second position, the shoulder strap may bow away from the housing. The slot may be disposed on a rigid member engaged with a sidewall of the one or more sidewalls of the housing. The first portion of the slot may include a larger diameter than the second portion of the slot. The projection may be sized and shaped such that it is prevented from rotating when disposed within the second portion of the slot, where the projection is sized and shaped such that it can rotate when disposed within the first portion of the slot. The locking hinge may further include a folding hinge defining a second pivot point for the shoulder strap relative to the housing about a second axis intersecting the first axis, the folding hinge allowing pivoting of the shoulder strap about the second axis for movement of the shoulder strap toward the housing when the projection is in the first position, and the folding hinge mitigating pivoting of the shoulder strap about the second axis when the projection is in the second position. When the projection is in the first position, the folding hinge may be disposed away from a rigid member containing the slot, and where, when the projection is in the second position, the folding hinge may be disposed adjacent to the rigid member where the rigid member inhibits pivoting thereof. The golf bag may further include a hydration system including a reservoir disposed in the housing and a tube extending from the reservoir. The tube may traverse on or through at least a portion of the shoulder strap. One or more of the tube and the shoulder strap may include a fixture structurally configured to couple the tube and the shoulder strap.

In an aspect, a method disclosed herein may include: moving a projectile disposed on an end of a shoulder strap of a bag from a first position to a second position relative to a slot engaged with the bag, where the projection is disposed within a first portion of the slot when in the first position, and where the projection is disposed within a second portion of the slot when in the second position; preventing pivoting of the shoulder strap relative to the bag about a first axis when the projection is in the second position; moving the projection from the second position to the first position such that the projection is disposed within the first portion of the slot; and permitting pivoting of the shoulder strap relative to the bag about the first axis when the projection is in the first position.

Implementations may include one or more of the following features. The method may further include placing the bag on a substantially horizontal surface such that the shoulder strap opposes the substantially horizontal surface, where a weight of the shoulder strap causes the movement of the projection from the first position to the second position. The method may further include lifting the bag by the shoulder strap thereby causing the movement of the projection from the second position to the first position such that the projection is disposed within the first portion of the slot. The method may further include maintaining a position of the shoulder strap away from the bag when the projection is in the second position. Preventing pivoting of the shoulder strap relative to the bag about the first axis when the projection is in the second position may cause the shoulder strap to be bowed away from the bag. The method may further include preventing a pivoting of the shoulder strap relative to the bag about a second axis that intersects the first axis when the projection is in the second position. The method may further include permitting a pivoting of the shoulder strap relative to the bag about a second axis that intersects the first axis when the projection is in the first position. Pivoting of the shoulder strap relative to the bag about the second axis may move the shoulder strap toward the bag thereby reducing a collective volume of the bag and the strap.

These and other features, aspects, and advantages of the present teachings will become better understood with reference to the following description, examples, and appended claim(s).

BRIEF DESCRIPTION OF THE DRAWINGS

The foregoing and other objects, features, and advantages of the devices, systems, and methods described herein will be apparent from the following description of particular embodiments thereof, as illustrated in the accompanying drawings. The drawings are not necessarily to scale, emphasis instead being placed upon illustrating the principles of the devices, systems, and methods described herein. In the drawings, like reference numerals generally identify corresponding elements.

DETAILED DESCRIPTION

Figure 1:
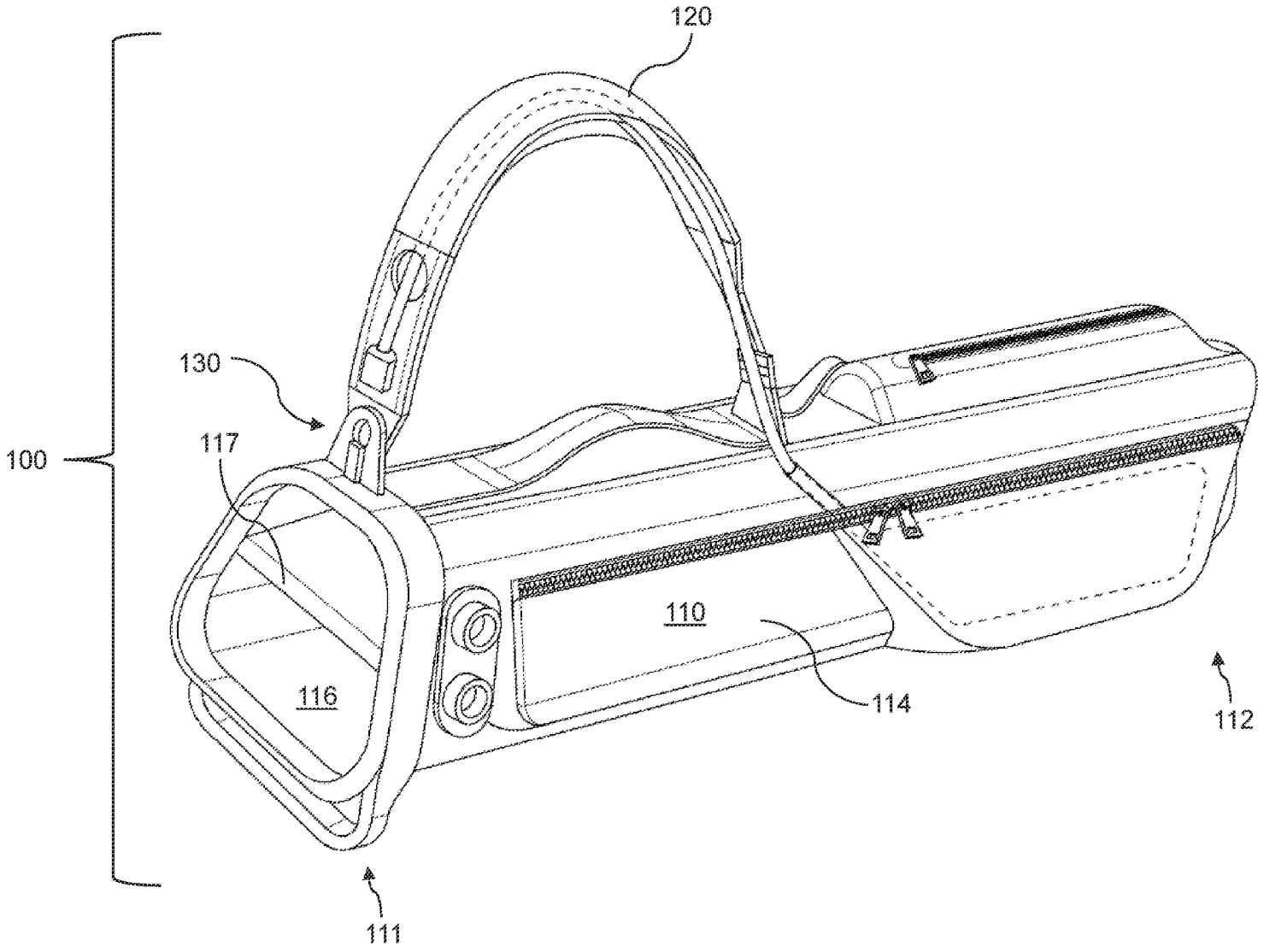
FIG. 1 illustrates a golf bag, in accordance with a representative embodiment.

The embodiments will now be described more fully hereinafter with reference to the accompanying figures, in which preferred embodiments are shown. The foregoing may, however, be embodied in many different forms and should not be construed as limited to the illustrated embodiments set forth herein. Rather, these illustrated embodiments are provided so that this disclosure will convey the scope to those skilled in the art.

All documents mentioned herein are hereby incorporated by reference in their entirety. References to items in the singular should be understood to include items in the plural, and vice versa, unless explicitly stated otherwise or clear from the text. Grammatical conjunctions are intended to express any and all disjunctive and conjunctive combinations of conjoined clauses, sentences, words, and the like, unless otherwise stated or clear from the context. Thus, the term "or" should generally be understood to mean "and/or" and so forth.

Recitation of ranges of values herein are not intended to be limiting, referring instead individually to any and all values falling within the range, unless otherwise indicated herein, and each separate value within such a range is incorporated into the specification as if it were individually recited herein. The words "about," "approximately" or the like, when accompanying a numerical value, are to be construed as indicating a deviation as would be appreciated by one of ordinary skill in the art to operate satisfactorily for an intended purpose. Similarly, words of approximation such as "about," "approximately," or "substantially" when used in reference to physical characteristics, should be understood to contemplate a range of deviations that would be appreciated by one of ordinary skill in the art to operate satisfactorily for a corresponding use, function, purpose, or the like. Ranges of values and/or numeric values are provided herein as examples only, and do not constitute a limitation on the scope of the described embodiments. Where ranges of values are provided, they are also intended to include each value within the range as if set forth individually, unless expressly stated to the contrary. The use of any and all examples, or exemplary language ("e.g.," "such as," or the like) provided herein, is intended merely to better illuminate the embodiments and does not pose a limitation on the scope of the embodiments. No language in the specification should be construed as indicating any unclaimed element as essential to the practice of the embodiments.

In the following description, it is understood that terms such as "first," "second," "top," "bottom," "up," "down," "above," "below," and the like, are words of convenience and are not to be construed as limiting terms unless specifically stated to the contrary.

The present teachings are generally directed to golf bag improvements and accessories. However, it should be understood that many of the embodiments of the present teachings may be used with, and/or may be adaptable for use with, other types of devices and systems including, for example, other bags, containers, carriers, luggage, and the like. Thus, unless explicitly stated to the contrary or otherwise clear from the context, the term "golf bag" as used herein may include other types of bags and the like.

Implementations of the present teachings may include devices, systems, and methods directed to a golf bag (or the like) that includes a selectively movable strap. More specifically, such a selectively movable strap may include a shoulder strap or another component, handle, strap, and the like on a golf bag that facilitates a user picking up, carrying, moving, accessing, and/or storing the bag. It will thus be understood that the term "shoulder strap" as used herein may include other straps, handles, and the like on a golf bag that may be used for lifting, carrying, otherwise moving, and/or storing the bag unless explicitly stated to the contrary or otherwise clear from the context. That is, the hinges and the like described herein may be used on other straps or components besides a "shoulder strap."

A selectively movable strap may be advantageous for bags and carriers such as golf bags and the like that are typically set down and picked up many times during their intended use—e.g., while playing a round of golf, while practicing, and the like. That is because several embodiments of the present teachings include a strap that is easily graspable by a user when the bag to which it is engaged is set down on a substantially horizontal surface (e.g., the ground) or otherwise placed in a substantially prone position. For example, a selectively movable strap may include a shoulder strap of a golf bag that sticks up, extends from, and/or otherwise bows away from the bag portion of the golf bag (which may otherwise be referred to herein as the "housing" of the golf bag) when the golf bag is placed on the ground with the strap located opposite to the surface upon which the bag rests. In this manner, the golf bag may be easily set down and subsequently lifted by a user by grasping the strap without having to bend over significantly. To this end, in certain implementations, a golf bag may include a hinge that releasably locks the strap in an extended position from the bag when the bag is placed on the ground or is otherwise set in a prone position. Moreover, in certain aspects, such a locking hinge can be released from its locked position—e.g., by lifting the golf bag, carrying the golf bag, and/or otherwise removing the golf bag from a prone position—such that the shoulder strap can pivot about the hinge along one or more axes. In this manner, the shoulder strap can be manipulated and carried with relative ease and comfort, without burdens or discomfort caused by movement restriction or otherwise having a stiff feel when carrying the bag by the shoulder strap. The passive nature of such a hinge may provide for ease of use. That is, the act of setting down the bag or otherwise placing it in a prone position may automatically cause the hinge to engage such that the strap is locked in an extended position from the bag; and, the act of picking up the bag by the strap (or otherwise applying a predetermined upward force on the strap) may automatically cause the hinge to release the strap from its locked state.

Also or instead, a golf bag or the like as described herein may include a hinge that locks a shoulder strap in a position extended away from the bag portion of the golf bag, but that can be released such that the shoulder strap can be placed adjacent to the bag portion of the golf bag, e.g., for storage and the like. This hinge—which may be referred to herein as a "folding hinge"—may be the same as, part of, and/or work in conjunction with the locking hinge described above and throughout this disclosure. As its name entails, the folding hinge may permit a shoulder strap to be folded against the golf bag, e.g., for storage and the like.

Therefore, embodiments of the present teachings may represent improvements over existing solutions such as golf bags including integrated stands and the like that can be used to prop-up the bag when it is not being carried. For example, aspects of the present teachings may lack the complexity, bulkiness, weight, frailness, etc. of these types of stands. Moreover, while some existing bags may include shoulder straps that are propped-up when set down, these bags can be uncomfortable for carrying and use, e.g., due to the rigidity and/or complexity of the straps—and thus the present teachings may include improvements over such existing solutions, e.g., through the inclusion of the releasably lockable hinges and the like as described herein.

FIG. 1 illustrates a golf bag, in accordance with a representative embodiment. As explained herein, the golf bag 100 described here may instead include another type of bag or carrier without departing from the scope of the present teachings. The golf bag 100 may generally include a housing 110, a shoulder strap 120, and a locking hinge 130. The golf bag 100 may be a full-size golf bag, a smaller type of golf bag for practicing and the like, a rigid bag, a flexible bag, a combination thereof, or otherwise.

The housing 110 may include a first end 111 defining one or more voids 116, where such voids 116 may be structurally configured to receive one or more golf clubs or other similar equipment therein (partially and/or wholly). One or more of these voids 116 may be wholly or partially separated by another one or more of the voids 116 via a divider 117. The housing 110 may further include a second end 112 opposite the first end 111, and one or more sidewalls 114 disposed between the first end 111 and the second end 112. The housing 110 may be wholly rigid, partially rigid, or wholly flexible. The housing 110 may be made from any material(s) in the art that is known to be beneficial for golf bags and the like such as a canvas material and similar.

The shoulder strap 120 may be engaged with the housing 110, e.g., where the shoulder strap 120 is at least partially connected to the housing 110 via the locking hinge 130 on at least one end thereof. That is, in an aspect, the shoulder strap 120 is connected on one end thereof to the housing 110 via the locking hinge 130, and on its opposite end, the shoulder strap 120 may be connected directly to the housing 110 (or indirectly, but not through a locking hinge 130 or the like). For example, the shoulder strap 120 may be connected on its opposite end via a hinge or other pivot point that lacks some or all of the features of the locking hinge 130 as described herein. In other aspects, multiple ends of the shoulder strap 120 are connected to the housing 110 via a locking hinge 130 or the like.

The shoulder strap 120 may be structurally configured for placement on or around a shoulder of a user for carrying the golf bag 100. However, and as explained above, the shoulder strap 120 may also or instead be structurally configured for engagement with other physiology of a user such as a user's hand, arm, back, torso, and so on.

The locking hinge 130 may establish selectively pivotable engagement between the shoulder strap 120 and the housing 110. The locking hinge 130 may also or instead establish selective positioning of the shoulder strap 120 relative to the housing 110—e.g., between a state where the shoulder strap 120 is in a substantially fixed position that is substantially bowed away from the housing 110, and a state where the shoulder strap 120 is pivotable relative to the housing 110, which can be beneficial for carrying the golf bag 100. An example embodiment of such a locking hinge is shown in FIG. 2 and described in more detail below.

Figure 2:
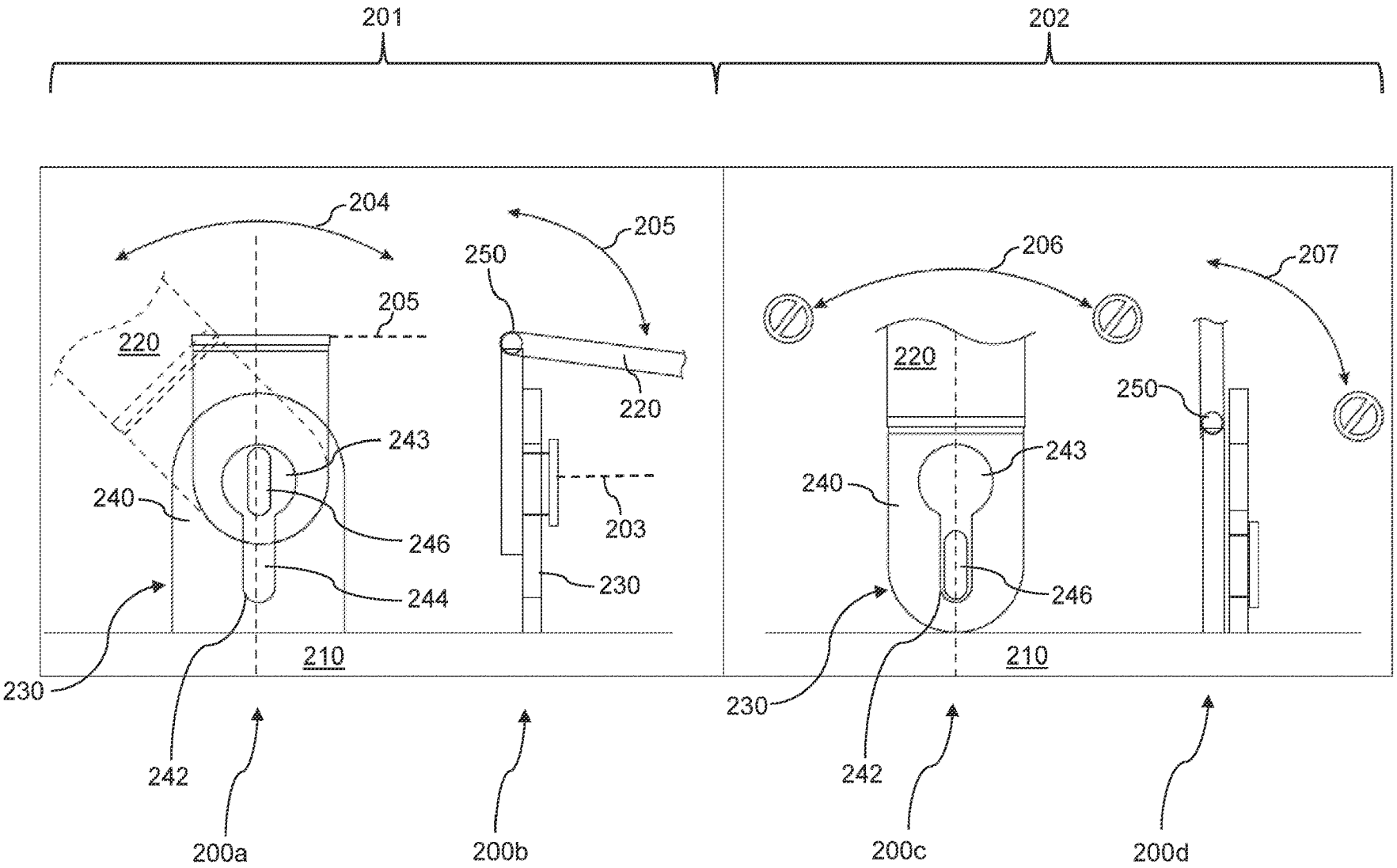
FIG. 2 illustrates a hinge for a bag, in accordance with a representative embodiment.

FIG. 2 illustrates a hinge for a bag, in accordance with a representative embodiment. The hinge may be a locking hinge 230 as described herein, where the locking hinge 230 establishes selectively pivotable engagement between a shoulder strap 220 and the housing 210 of a bag such as a golf bag (e.g., the golf bag 100 of FIG. 1). In FIG. 2, multiple views of the locking hinge 230 are shown for clarity—i.e., a first view 200*a* showing the front of the locking hinge 230 in a pivotable state, such as for carrying a golf bag, where the shoulder strap 220 is movable in the directions shown by arrows 204; a second view 200*b* showing the side of the locking hinge 230 in the pivotable state, where the shoulder strap 220 may also or instead be foldable in the direction of arrows 205 when in this state; a third view 200*c* showing the front of the locking hinge 230 in a non-pivotable (and/or substantially-fixed) state, such as when the golf bag is set down on a substantially horizontal surface such as the ground, and where the shoulder strap 220 may be bowed away from a bag to which it is engaged and/or where the shoulder strap 220 is mitigated from moving in the directions shown by arrows 206; and a fourth view 200*d* showing the side of the locking hinge 230 in the non-pivotable state, where the shoulder strap 220 may also or instead be mitigated from folding in the direction of arrows 207 when in this state. As described herein, to facilitate one or more of the aforementioned states and functionality, the locking hinge 230 may generally include a slot 242 and a projection 246.

The slot 242 may be engaged with the housing 210. For example, the slot 242 may be integrally formed on the housing 210 or a component connected thereto. In certain aspects, the slot 242 is disposed on a rigid member 240 engaged with a sidewall (or other portion) of the housing 210. The rigid member 240 may include a metal member, a substantially durable plastic member, and/or the like. By way of example, the rigid member 240 may include a metal and/or hard plastic member that projects from the housing 210 and that contains a slot 242 therein or thereon.

The slot 242 may define a void having a first portion 243 and a second portion 244. As shown in the figure, in certain aspects, the first portion 243 of the slot 242 includes a larger diameter relative to the second portion 244 of the slot 242. In this manner, in certain aspects, the projection 246 may be sized and shaped such that it is prevented from rotating when disposed within the second portion 244 of the slot 242, and the projection 246 may be sized and shaped such that it is able to rotate when disposed within the first portion 243 of the slot 242. For example, the projection 246 may be formed as a substantially elongated member (e.g., an oblong shape or the like), where the projection 246 can rotate within the first portion 243 of the slot thereby allowing for rotation of a shoulder strap 220 to which it is engaged; and the projection 246, which again may be formed as a substantially elongated member, may fit within the second portion 244 of the slot 242 in a predetermined manner that mitigates rotation thereof, thereby mitigating or preventing rotation of a shoulder strap 220 to which it is engaged.

The projection 246 may be engaged with an end of the shoulder strap 220. In some aspects, the projection 246 may be integrally formed on the strap 220 or a component connected thereto such as a rigid endcap or the like. The projection 246 may be slidable within the slot 242 between a first position 201 when disposed within the first portion 243 (as shown in the first view 200*a* and the second view 200*b*) and a second position 202 when disposed within the second portion 244 (as shown in the third view 200*c* and the fourth view 200*d*). As explained above, the projection 246 and the slot 242 may be sized and shaped such that the projection 246 can rotate when disposed in its first position 201, and the projection 246 and the slot 242 may be sized and shaped such that the projection 246 is mitigated or prevented from rotating when disposed in its second position 202. In this manner, in certain aspects, when the projection 246 is in the first position 201, the strap 220 may be substantially pivotable about a first axis 203 relative to the housing 210 as shown by the arrows 204. And, in this manner, in certain aspects, when the projection 246 is in the second position 202, the strap 220 may be mitigated (or outright prevented) from pivoting about the first axis 203.

The locking hinge 230, or the golf bag 100 more generally, may further include a folding hinge 250. The folding hinge 250 may define a second pivot point for the shoulder strap 220 relative to the housing 210 about a second axis 205 intersecting the first axis 203. The folding hinge 250 may allow for pivoting of the shoulder strap 220 about the second axis 205 for movement of the shoulder strap 220 toward the housing 210 (as shown by the arrows 205) when the projection 246 is in the first position 201. Moreover, the folding hinge 250 may mitigate (or outright prevent) pivoting of the shoulder strap 220 about the second axis 205 when the projection 246 is in the second position 202.

The folding hinge 250 may function by being blocked from permitting the shoulder strap 220 from pivoting when the projection 246 is in the second position 202, and the folding hinge 250 may be freed from this blocking when the projection 246 is in the first position 201. To this end, in some aspects and as shown in the figure, when the projection 246 is in the first position 201, the folding hinge 250 may be disposed away from the rigid member 230 containing the slot 242, and when the projection 246 is in the second position 202, the folding hinge 250 may be disposed adjacent to the rigid member 230 where the rigid member 230 inhibits pivoting thereof.

One or both of the locking hinge 230 and the folding hinge 250 may operate in a passive manner. For example, one or both of the locking hinge 230 and the folding hinge 250 may automatically prevent or mitigate pivoting of the shoulder strap 220 when the golf bag is placed in a substantially prone position (e.g., within 25-degrees of horizontal, within 45-degrees of horizontal, or similar). In this manner, in certain aspects, when the housing 210 is placed on a substantially horizontal surface such that the shoulder strap 220 opposes the substantially horizontal surface (i.e., the shoulder strap is facing upward), weight of the shoulder strap 220 may provide a force to move the projection 246 within the slot 242 from the first position 201 to the second position 202 thereby preventing or mitigating pivoting of the shoulder strap 220 as described herein. Further, in certain aspects, in the absence of other forces, the weight of the shoulder strap 220 may maintain the projection 246 in the second position 202 when the housing 210 is placed on a substantially horizontal surface (or otherwise placed in a substantially prone position) with the shoulder strap 220 facing upward. Moreover, in some implementations, when the projection 246 is in the second position 202, the shoulder strap 220 may automatically bow away from the housing 210. This can be done through material selection and/or reinforcing or bracing of the shoulder strap 220. Moving the projection 246 from the second position 202 to the first position 201 may be caused by the application of a predetermined upward force, which may be greater than or equal to the weight of the shoulder strap 220. Thus, lifting the golf bag by the shoulder strap 220 may cause the projection 246 to move to the first position 201 where it can be pivoted about the first axis 203. And, when carrying the golf bag by the shoulder strap 220 (e.g., with the shoulder strap 220 disposed over or around a user's shoulder), the projection 246 may be automatically maintained in the first position 201 where it can be pivoted about the first axis 203 through the configuration of the locking hinge 230. That is, the weight of the golf bag itself may maintain the projection 246 in the first position 201 when the bag is being carried. This may provide for comfort and relative ease of motion when carrying the golf bag, e.g., by allowing it to swing according to a carrier's movements.

Figure 3:
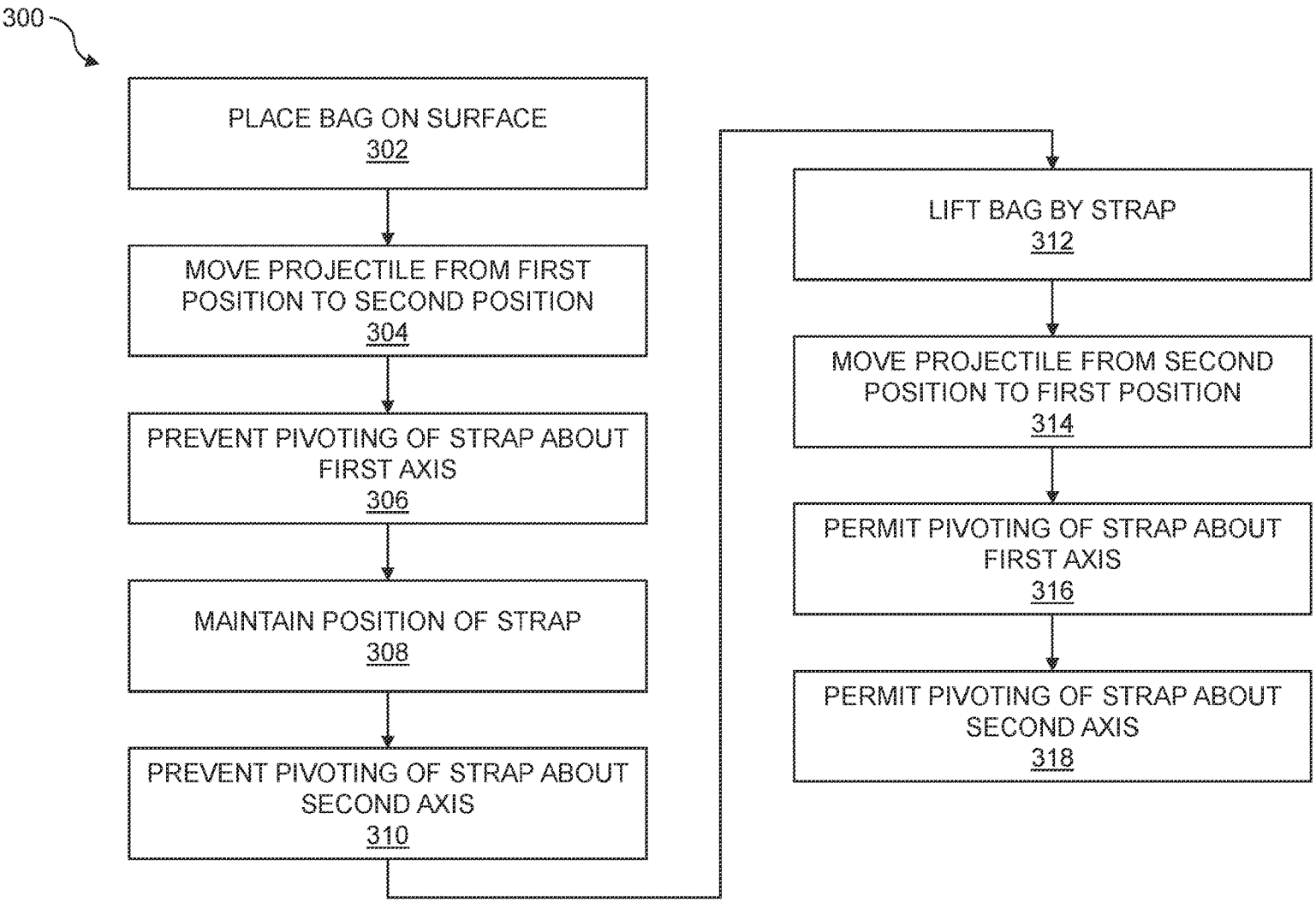
FIG. 3 is a flowchart of a method for selectively moving a strap, in accordance with a representative embodiment.

FIG. 3 is a flowchart of a method for selectively moving a strap, in accordance with a representative embodiment. The method 300 may be implemented using one or more of the devices and systems described herein—e.g., the golf bag 100 of FIG. 1 and/or the locking hinge 230 of FIG. 2. Generally, the method 300 may be implemented using a bag having a strap (e.g., shoulder strap or the like) that is connected to the bag via one or more locking hinges as described herein.

As shown in step 302, the method 300 may include placing a bag on a substantially horizontal surface such that a shoulder strap thereof opposes the substantially horizontal surface. This may also or instead include placing the bag in a substantially prone position, such as on the playing surface of a golf course, a driving range, a practice area, and so on.

As shown in step 304, the method 300 may include moving a projection disposed on an end of the shoulder strap of the bag from a first position to a second position relative to a slot engaged with the bag. As described herein, the projection may be disposed within a first portion of the slot when in the first position, and the projection may be disposed within a second portion of the slot when in the second position. Movement of the projection from the first position to the second position may be caused by placing the bag in a substantially prone position as per step 302 described above. Where, in such a substantially prone position, the weight of the shoulder strap may cause movement of the projection from the first position to the second position as described herein (e.g., via gravity from the weight of the strap, which can move the projection, when so aligned, into the second position, such as via a sliding movement or the like).

As shown in step 306, the method 300 may include preventing pivoting of the shoulder strap relative to the bag about a first axis when the projection is in the second position. This may be caused by the specific design (size and/or shape) of the projection relative to the slot, and/or relative alignment thereof. Thus, in this manner, when the projection is in the second position, the relative position of the shoulder strap to the housing may be substantially maintained (i.e., where the shoulder strap is prevented from pivoting away from this position).

As shown in step 308, the method 300 may include maintaining a position of the shoulder strap away from the bag when the projection is in the second position. In certain aspects, preventing pivoting of the shoulder strap relative to the bag about the first axis when the projection is in the second position automatically causes the shoulder strap to be bowed away from the bag, thereby maintaining a position of the shoulder strap away from the bag. This may be accomplished using one or more stabilizers (e.g., flexible rods or the like) that are present on or within the shoulder strap. A material of the shoulder strap may also or instead provide such rigidity to maintain the bowed state thereof when the projection is in the second position. In some aspects, the shape of the shoulder strap is substantially fixed into the bowed shape, i.e., in a permanent manner. In such aspects, a folding hinge or the like described herein may be used to aid in transport or storage of a bag having such a fixed shape shoulder strap.

As shown in step 310, the method 300 may include preventing a pivoting of the shoulder strap relative to the bag about a second axis that intersects the first axis when the projection is in the second position. Thus, in this manner, when the projection is in the second position, the relative position of the shoulder strap to the housing may be substantially maintained (i.e., where the shoulder strap is prevented from pivoting away and/or folding away from this position).

As shown in step 312, the method 300 may include lifting the bag by the shoulder strap, or otherwise providing a predetermined upward force on the shoulder strap. This may cause movement of the projection from the second position to the first position such that the projection is disposed within the first portion of the slot. In some aspects, the predetermined upward force is any force able to counteract and overcome downward forces from the weight of the shoulder strap, e.g., a force greater than the weight of the shoulder strap.

Thus, as shown in step 314, the method 300 may include moving the projection from the second position to the first position such that the projection is disposed within the first portion of the slot; which again, may be caused by lifting the bag by the shoulder strap or otherwise providing a predetermined upward force on the shoulder strap.

As shown in step 316, the method 300 may include permitting pivoting of the shoulder strap relative to the bag about the first axis when the projection is in the first position. This pivoting may allow for ease of use and comfort when a user is carrying a bag via the shoulder strap, particularly when the user is moving about such as walking a golf course and the like.

As shown in step 318, the method 300 may include permitting a pivoting of the shoulder strap relative to the bag about a second axis that intersects the first axis when the projection is in the first position. This pivoting may allow for the shoulder strap to be folded, and/or, similar to the above, it may allow for ease of use and comfort when a user is carrying a bag via the shoulder strap, particularly when the user is moving about such as walking a golf course and the like.

Figure 4:
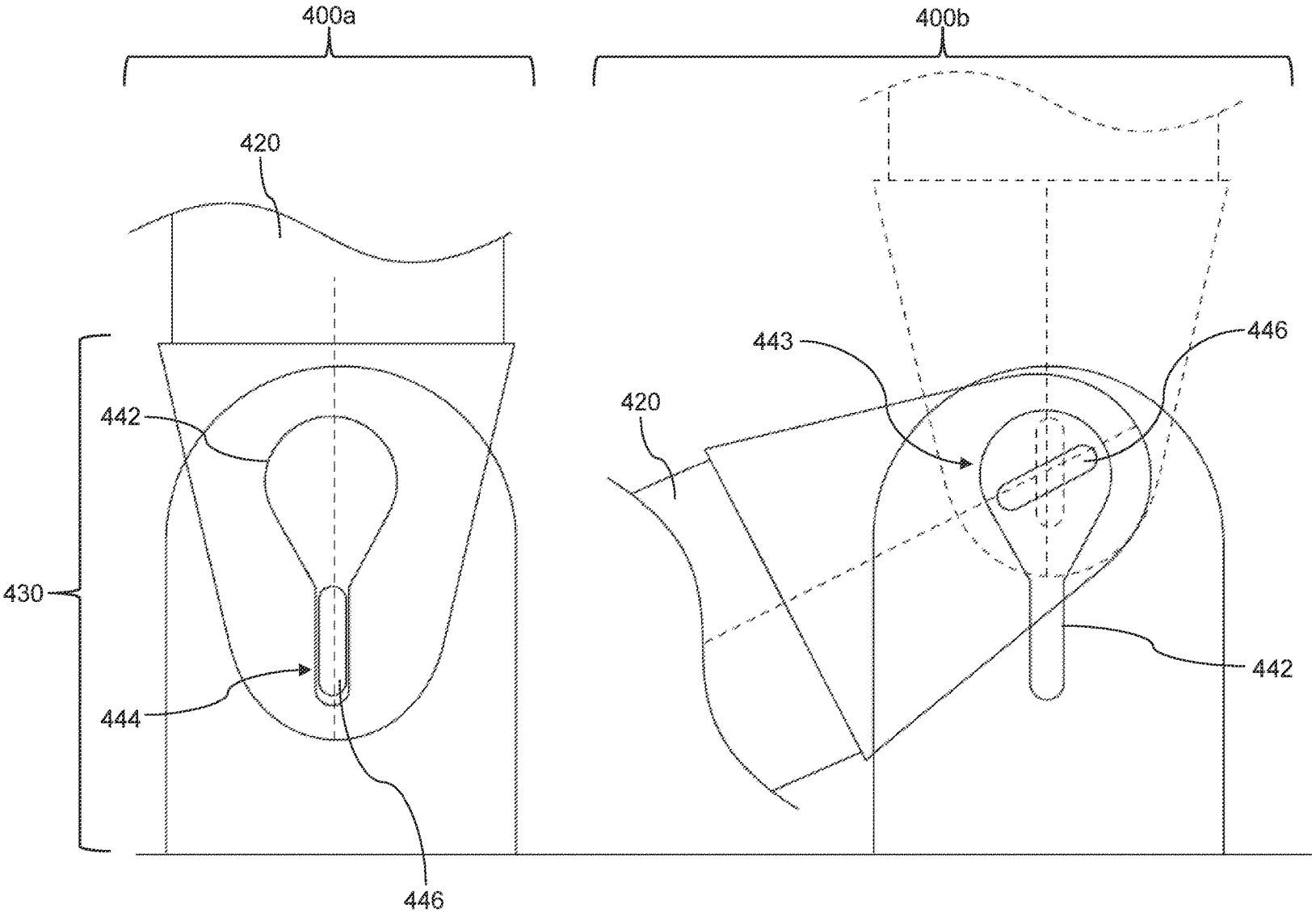
FIG. 4 illustrates a hinge for a bag, in accordance with a representative embodiment.

FIG. 4 illustrates a hinge for a bag, in accordance with a representative embodiment. The locking hinge 430 shown in this figure may be the same as, or similar to, the locking hinge described above, e.g., with reference to FIG. 2, and may thus include some of the same features as described above, e.g., with reference to FIG. 2. Turning back to FIG. 4, two views are shown—a first view 400*a* and a second view 400*b*. The first view 400*a* shows the locking hinge 430 in a locked or fixed position (e.g., with a projection 446 disposed within a second portion 444 of a slot 442, where the projection 446 is mitigated or prevented from rotation in such a position, thereby substantially fixing a relative position of a strap 420 to which it is engaged). The second view 400*b* shows the locking hinge 430 in a rotatable configuration, position, or state (e.g., with the projection 446 disposed within a first portion 443 of the slot 442, where the projection 446 can rotate in such a position, thereby allowing for a similar rotation of the strap 420 to which it is engaged). In this manner, the first view 400*a* may represent a state where a bag having the locking hinge 430 is placed on the ground, where forces from the weight of the strap 420 cause the projection 446 to slide within the second portion 444 of the slot 442, and where the projection 446 and slot 442 are each structurally configured (e.g., sized and shaped) such that the projection 446 (and thus a strap 420 to which it is engaged) cannot rotate when disposed in the second portion 444. And, in this manner, the second view 400*b* may represent a state where a bag having the locking hinge 430 is picked up or is being carried, where a force opposing the weight of the strap 420 causes the projection 446 to slide up into the first portion 443 of the slot 442, and where the projection 446 and slot 442 are each structurally configured (e.g., sized and shaped) such that the projection 446 (and thus a strap 420 to which it is engaged) is permitted to rotate when disposed in the first portion 443. As shown in the second view 400*b*, as explained below, the size and shape of the projection 446 (and the slot 442) may be structurally configured such that, when the projection 446 is in the first position and the shoulder strap 420 is pivoted in a predetermined manner (e.g., a predetermined amount of pivoting), the projection 446 is prevented from returning to the second position. The projection 446 may thus include a substantially elongated shape, such as an oblong shape, an oval shape, a rectangular shape, or the like.

Figure 5:
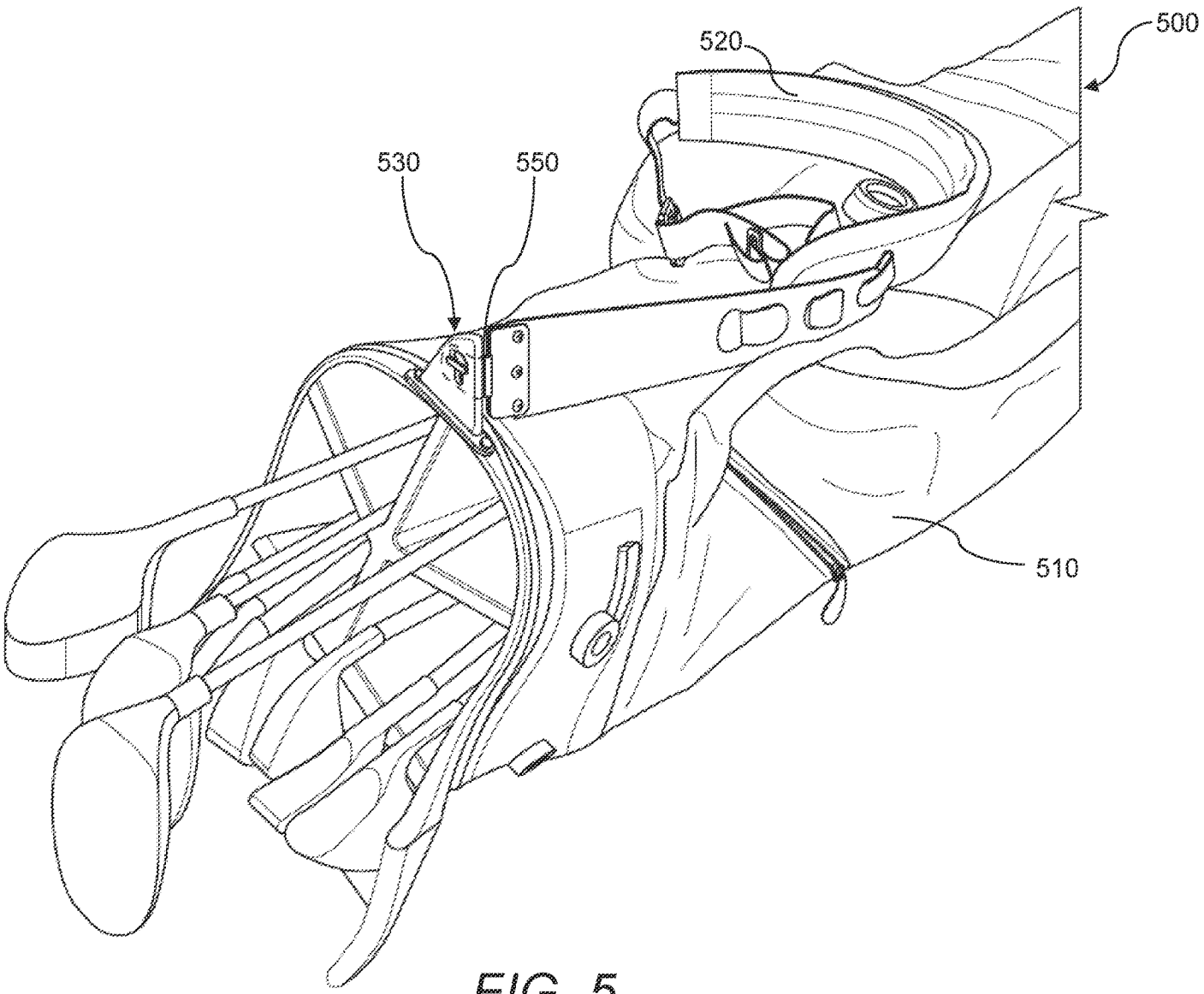
FIG. 5 illustrates a golf bag, in accordance with a representative embodiment.

FIG. 5 illustrates a golf bag, in accordance with a representative embodiment. In this figure, a projection of a locking hinge 530 of the golf bag 500 may be in the first position as described herein, such that the shoulder strap 520 of the golf bag 500 is pivotable such that it can rest adjacent to the bag portion/housing 510 of the golf bag 500. More specifically, this figure shows an embodiment where the locking hinge 530 of the golf bag 500 is manipulatable by a user in the prone position to move the projection of the locking hinge 530 from the second position to the first position such that the shoulder strap 520 can be placed adjacent to the housing 510. In an aspect, this is accomplished by lifting the shoulder strap 520 slightly (i.e., to move the projection from the second position to the first position by counteracting forces from the weight of the shoulder strap 520 that are otherwise maintaining the projection into the first position) and then pivoting the shoulder strap 520 while lifted slightly (i.e., while the projection is in the first position). The size and shape of the projection (and the slot) may be structurally configured such that, when the projection is in the first position and the shoulder strap 520 is pivoted towards the housing 510 in a predetermined manner (e.g., a predetermined amount of pivoting), the projection is prevented from returning to the second position. In other words, the shoulder strap 520 may need to be in a particular position (e.g., a substantially unpivoted position where it is disposed directly above the golf bag 500 or housing 510 thereof) in order to move the projection from the first position to the second position. In some aspects, the projection includes a substantially oblong shape in order to accommodate this feature.

The locking hinge 530 of the golf bag 500 may further include a folding hinge 550, which may be the same as or similar to any of such hinges as described herein. The folding hinge 550 may be used to manipulate the shoulder strap 520, e.g., for storage, transport, or the like.

Figure 6:
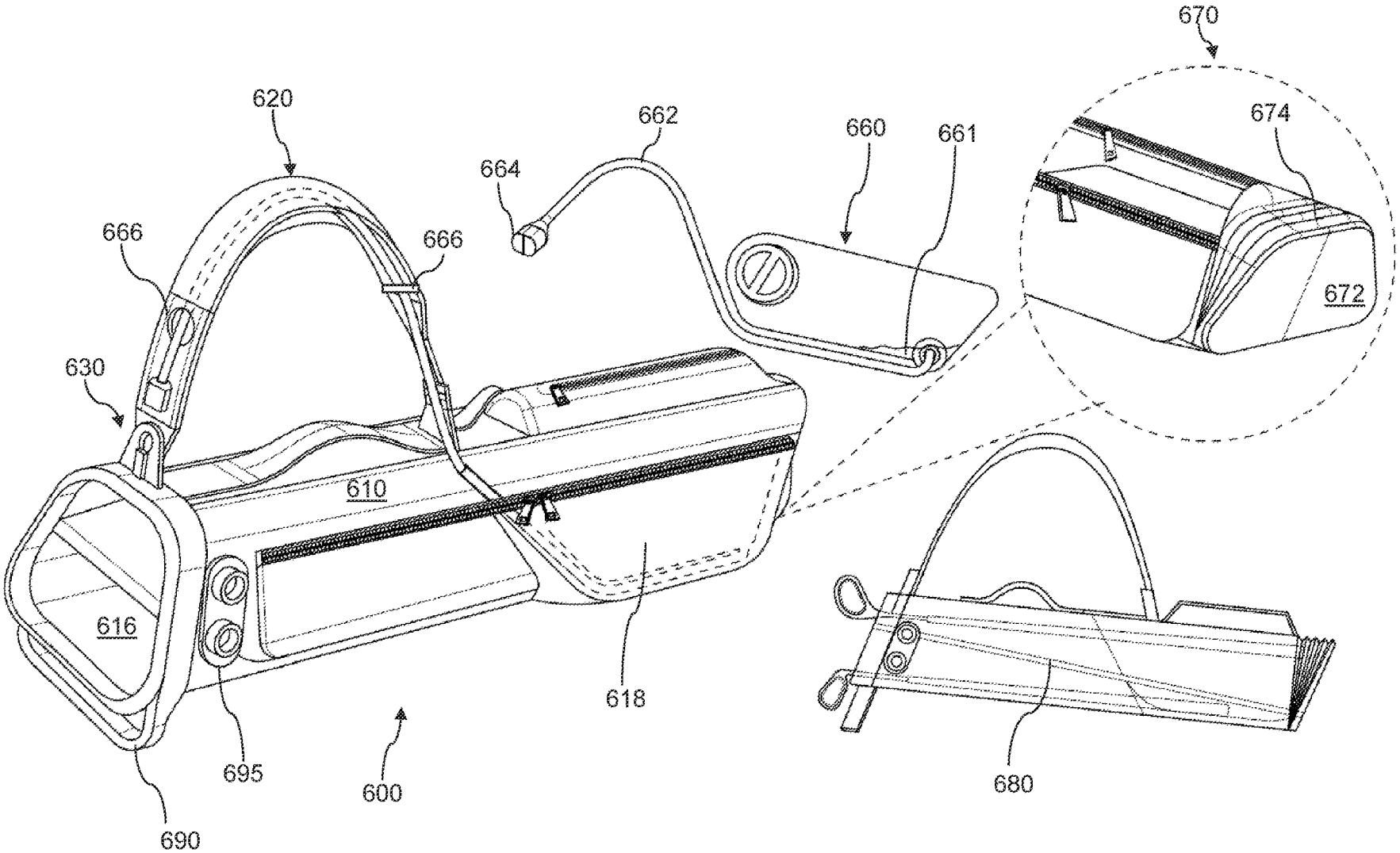
FIG. 6 illustrates a golf bag, in accordance with a representative embodiment.

FIG. 6 illustrates a golf bag, in accordance with a representative embodiment. The golf bag 600 may be any as described herein, and may for example include one or more locking hinges 630 for a strap (e.g., shoulder strap 620) as described herein. The golf bag 600 may also or instead include several other advantageous features, some examples of which are described below.

The golf bag 600 may include a hydration system for providing a beverage 661 to a user (e.g., water) or otherwise providing a fluid. In this manner, the golf bag 600 may include a reservoir 660 that can be filled by a user with a beverage 661 such as water. The reservoir 660 may be removable and/or replaceable. In some aspects, the reservoir 660 is integral with the golf bag 600. In some aspects, the reservoir 660 is substantially flexible (e.g., the reservoir 660 may include an expandable and contractable bag or the like, made of a plastic material or the like). In other aspects, the reservoir 660 is substantially rigid and substantially fixed in shape. In some aspects, the reservoir 660 is disposable. In some aspects, the reservoir 660 is included in one or more predetermined pockets 618 of the golf bag 600, which may be separated from other pockets, compartments, and/or voids within the golf bag 600. In an aspect, a predetermined pocket 618 suitable for containing the reservoir 660 may be included on a plurality of sides of the housing 610. Some aspects include a plurality of reservoirs 660.

The hydration system may further include a tube 662, e.g., a flexible tube that extends from the reservoir 660 to another location for access by a user to drink from or otherwise engage for accessing contents of the reservoir 660. The end of the tube 662 that extends away from the reservoir may include a bite valve 664 or the like. The tube 662 may traverse at least partially through a strap of the golf bag 600 such as the shoulder strap 620. The tube 662 (or other parts of the hydration system) may include fixtures 666 for affixing the tube 662 (or other parts of the hydration system) to the golf bag 600. Such fixtures 666 may, for example, include magnetic fixtures and the like.

Thus, a hydration system may include a reservoir 660 and a tube 662 engaged therewith through which a fluid (e.g., a beverage 661) can be drawn by a user from the reservoir 660. The connection of the tube 662 to the reservoir 660 may be structurally configured such that the reservoir 660 can be substantially emptied via the tube 662 when in use. For example, the connection may be disposed at a bottom corner of the reservoir 660 as shown in the figure.

Further, and as described above, the tube 662 (or other parts of the hydration system or golf bag 600) may include fixtures 666 for affixing the tube 662 (or other parts of the hydration system or golf bag 600) to the golf bag 600. Such fixtures 666 may, for example, include magnetic fixtures and the like. For example, in some aspects, the shoulder strap 620 of the golf bag 600 includes a magnetic coupling structurally configured for the tube 662 to magnetically couple with, i.e., when the tube 662 has a corresponding magnetic coupling disposed thereon. Further, the magnetic coupling on the shoulder strap 620 (or other strap of the golf bag 600) may also or instead be used for the attachment of other accessories having a corresponding magnetic coupling disposed thereon, such as a range finder or other electronic devices, a towel, tees, balls, cleaning accessories, clothing, other golf equipment, safety equipment, and so forth.

The golf bag 600 may also or instead include an expandable portion 670—e.g., where at least a portion of the second end of the golf bag 600 is expandable, movable, or otherwise adaptable. The expandable portion 670 of the golf bag 600 may include a bottom plate 672 and one or more bellows 674 to facilitate movement of the bottom plate 672 away from the housing 610 (i.e., expansion of the second end of the golf bag 600), and contraction back toward the housing 610 (i.e., for shortening the second end of the golf bag 600). The expandable portion 670 may be positionable such that the bottom of the golf bag 600 is flat or angled, depending on the amount of expansion or contraction thereof. The expandable portion 670 may facilitate longer golf clubs, improve golf club visibility/management, allow for easier storage and portability, and so on.

The golf bag 600 may also or instead include a support bar 680 that accommodates one or more of the features described above. That is, the support bar 680 may be disposed at an angle such that the bottom portion of the golf bag 600 is expandable. More specifically, the support bar 680 may engage with a non-expanding end (e.g., at an angle, or otherwise), where the bottom portion of the golf bag 600 further includes an expanding end opposite the non-expanding end. The support bar 680 may also or instead supply tension to the housing 610 of the golf bag 600 in order to maintain a predetermined shape, and/or to bias or tension the housing 610 toward a predetermined shape.

The golf bag 600 may also or instead include a stabilizer 690 on a first end of the golf bag 600 where golf clubs or the like are intended to be inserted. The stabilizer 690 may lift the first end of the golf bag 600 when the golf bag 600 is in a prone position, such as when the golf bag 600 is set on the ground, such that the first end of the golf bag 600 is raised off of the ground. This may protect golf clubs or other components that extend from the void(s) 616 on the front end of the golf bag 600, e.g., by preventing contact with the ground or another surface. The stabilizer 690 may also or instead be sized and shaped to act as a handle for the golf bag 600, e.g., the bottom side of the golf bag 600 (such as to ease in placement and/or removal from a golf cart and the like).

The golf bag 600 may also or instead include an accessory bar 695 or the like, e.g., for the attachment of one or more accessories to the golf bag 600. Such accessories may include without limitation one or more of golf tees, golf balls, brushes and other cleaning supplies, a towel, a divot repair tool, a ball marker, a scorecard, a writing instrument, a tag, an electronic component or device, a communications component or device, a glove or other clothing, and so forth. The accessory bar 695 may be removable. The accessory bar 695 may also or instead be affixable to one or more of the sidewalls of the housing 610—e.g., either side of the housing 610 to provide for either left or right shoulder carrying of the golf bag 600 without interference from the accessory bar 695 or items contained thereon. Affixing the accessory bar 695 may be accomplished via a hook and loop fastening system, buttons, snaps, magnets, friction fits, and/or the like.

Figure 7:
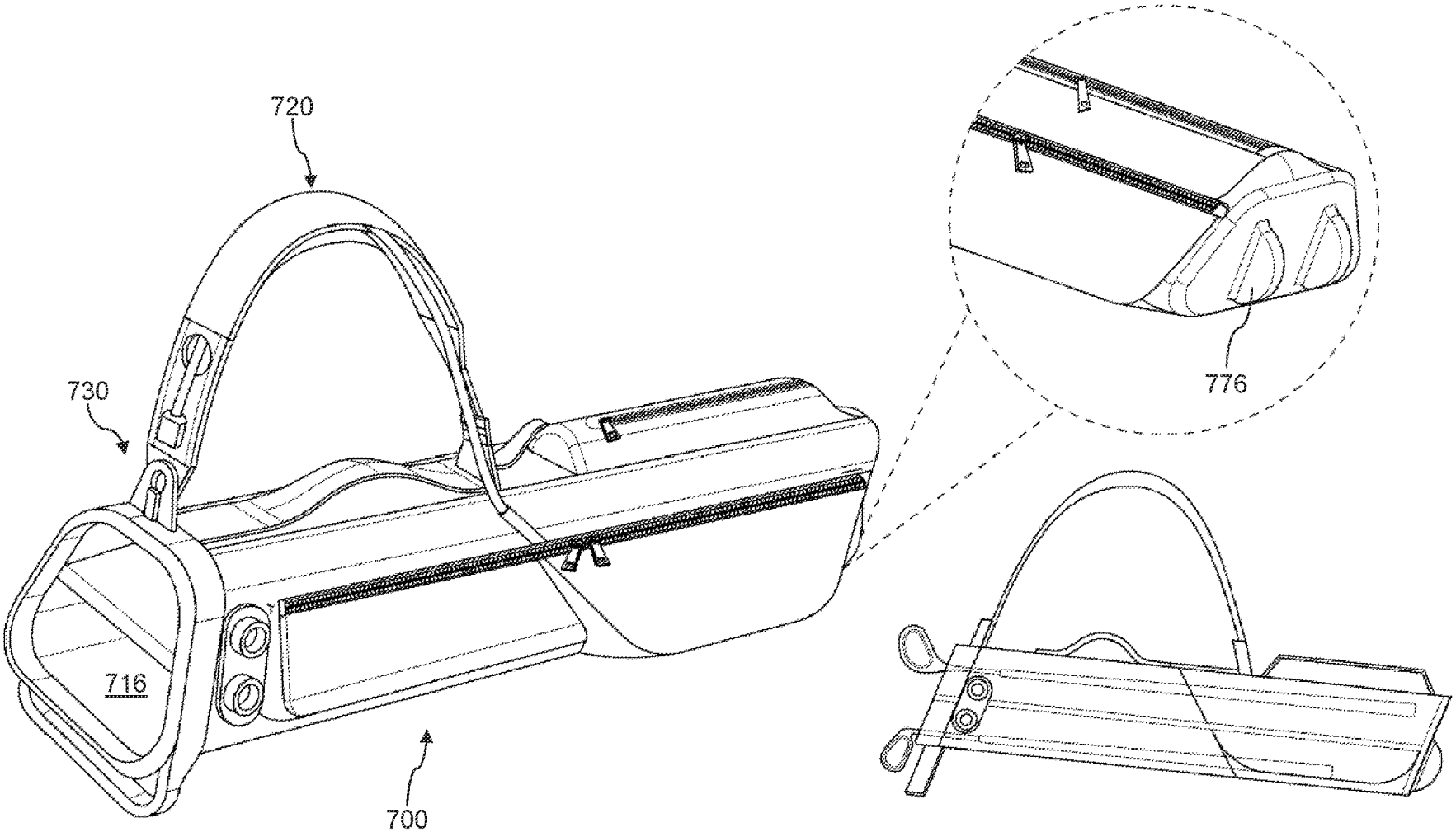
FIG. 7 illustrates a golf bag, in accordance with a representative embodiment.

FIG. 7 illustrates a golf bag, in accordance with a representative embodiment. The golf bag 700 may be the same or similar to any as described herein, and may for example include a locking hinge 730 for the shoulder strap 720 (or other strap) as described herein. The golf bag 700 may also or instead include several other advantageous features, such as any of the features described with reference to FIG. 6 or other embodiments described herein.

The golf bag 700 may also or instead include one or more feet 776 that are structurally configured to mitigate snagging or catching on other devices or components, such as a golf cart. The feet 776 may be disposed on the second end of the golf bag 700 away from the voids 716 located on the first end of the golf bag 700. The second end of the golf bag 700 may be angled, e.g., to facilitate different sized objects such as golf clubs having varying lengths. The second end of the golf bag 700 may be substantially rigid.

Figure 8:
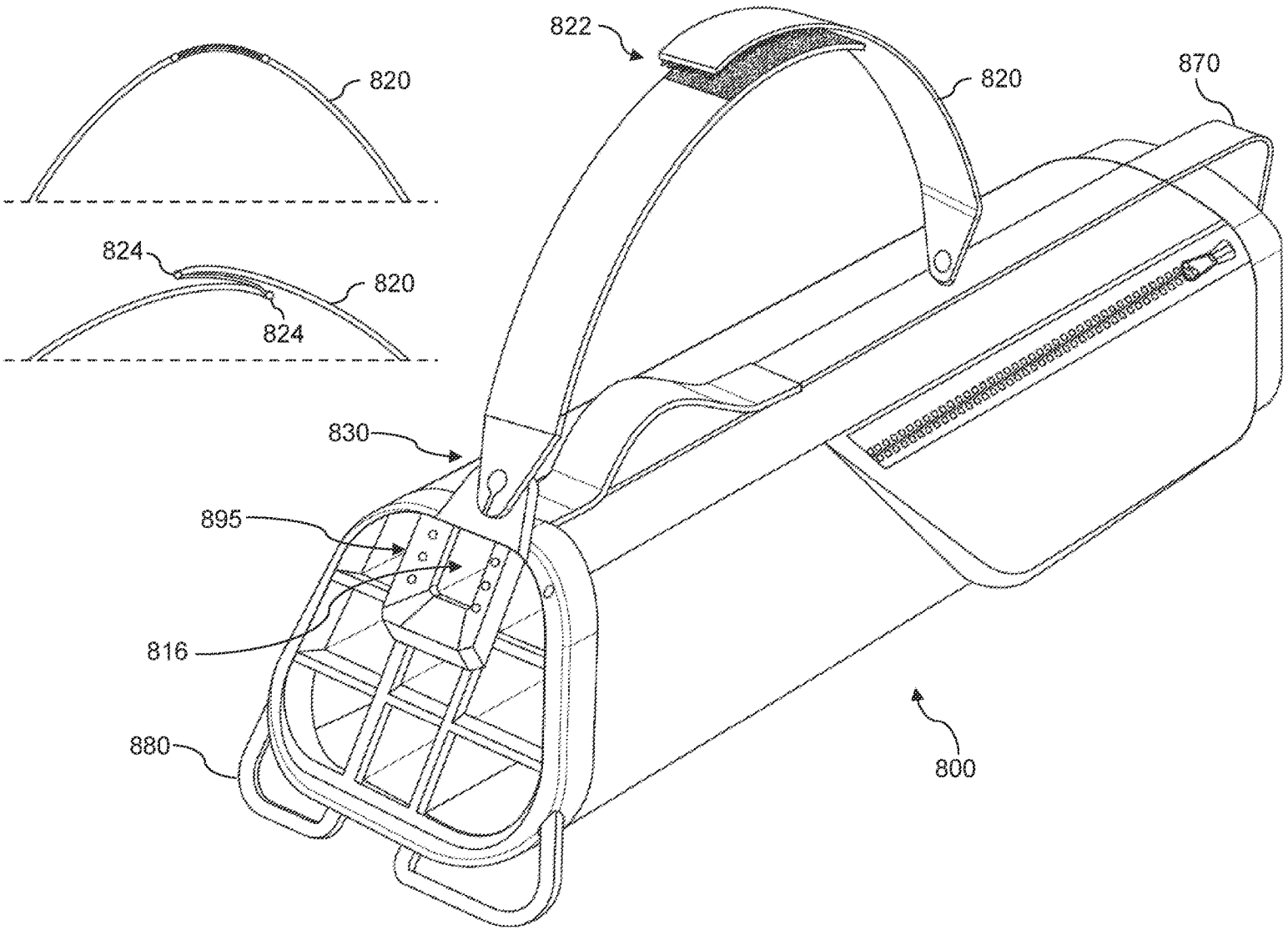
FIG. 8 illustrates a golf bag, in accordance with a representative embodiment.

FIG. 8 illustrates a golf bag, in accordance with a representative embodiment. The golf bag 800 shown in this figure may include one or more of any of the features described herein with reference to other bags described herein. For example, the golf bag 800 may include a locking hinge 830 that selectively couples a shoulder strap 820 thereto in either a substantially movable position or a substantially fixed position.

The golf bag 800 may also or instead include a shoulder strap 820 having an adjustment mechanism 822. The adjustment mechanism 822 may include hook and loop fastening components (or components with other, similar fastening characteristics), where adjustment of the strap can be accomplished via folding (or otherwise coupling or grouping) portions of the shoulder strap 820 to other cooperating portions of the shoulder strap 820 as shown in the figure to shorten the shoulder strap 820, and where un-folding or uncoupling in a similar manner can allow for expanding the shoulder strap 820. In some aspects, the adjustment mechanism 822 of the shoulder strap 820 includes one or more adjustment links 824 to aid in the folding and/or coupling of the shoulder strap 820 for adjustments thereof. In certain aspects, the shoulder strap 820 may be adjusted by about 7 inches, although other adjustment sizes are certainly possible and are intended to be included herein. The adjustment mechanism 822 may also or instead be any known in the art.

The golf bag 800 may also or instead include a projected portion 870 on a bottom side thereof, e.g., to accommodate relatively lengthy golf clubs such as a driver, certain woods, certain putters, and/or relatively long irons. Access to the projected portion 870 from an interior portion of the golf bag 800 may be along a predetermined pathway, e.g., from one or more of the voids 816 of the golf bag 800. That is, one or more relatively long items (e.g., golf clubs) may have a predetermined void 816 for insertion therein, where this predetermined void 816 will allow the item to traverse and settle into an interior of the projected portion 870 of the golf bag 800. As shown in the figure, such a predetermined void 816 may feature accessory storage 895, which can be specifically tailored for use with the certain long item. For example, an aspect may include a predetermined void 816 specifically sized and shaped to accommodate a driver, where the accessory storage 895 at least partially surrounds the void 816 and includes holes or the like for tees or other pertinent accessories.

The golf bag 800 may also or instead include one or more support bars 880, which may be the same or similar to others as described herein.

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings.

Unless the context clearly requires otherwise, throughout the description, the words "comprise," "comprising," "include," "including," and the like are to be construed in an inclusive sense as opposed to an exclusive or exhaustive sense; that is to say, in a sense of "including, but not limited to." Additionally, the words "herein," "hereunder," "above," "below," and words of similar import refer to this application as a whole and not to any particular portions of this application.

It will be appreciated that the devices, systems, and methods described above are set forth by way of example and not of limitation. Absent an explicit indication to the contrary, the disclosed steps may be modified, supplemented, omitted, and/or re-ordered without departing from the scope of this disclosure. Numerous variations, additions, omissions, and other modifications will be apparent to one of ordinary skill in the art. In addition, the order or presentation of method steps in the description and drawings above is not intended to require this order of performing the recited steps unless a particular order is expressly required or otherwise clear from the context.

The method steps of the implementations described herein are intended to include any suitable method of causing such method steps to be performed, consistent with the patentability of the following claims, unless a different meaning is expressly provided or otherwise clear from the context. So, for example performing the step of X includes any suitable method for causing another party such as a remote user, a remote processing resource (e.g., a server or cloud computer) or a machine to perform the step of X. Similarly, performing steps X, Y, and Z may include any method of directing or controlling any combination of such other individuals or resources to perform steps X, Y, and Z to obtain the benefit of such steps. Thus, method steps of the implementations described herein are intended to include any suitable method of causing one or more other parties or entities to perform the steps, consistent with the patentability of the following claims, unless a different meaning is expressly provided or otherwise clear from the context. Such parties or entities need not be under the direction or control of any other party or entity, and need not be located within a particular jurisdiction.

It will be appreciated that the methods and systems described above are set forth by way of example and not of limitation. Numerous variations, additions, omissions, and other modifications will be apparent to one of ordinary skill in the art. In addition, the order or presentation of method steps in the description and drawings above is not intended to require this order of performing the recited steps unless a particular order is expressly required or otherwise clear from the context. Thus, while particular embodiments have been shown and described, it will be apparent to those skilled in the art that various changes and modifications in form and details may be made therein without departing from the spirit and scope of this disclosure and are intended to form a part of the invention as defined by the following claims, which are to be interpreted in the broadest sense allowable by law.

What is claimed is:

1. A golf bag, comprising:

a housing comprising a first end defining one or more voids configured to receive one or more golf clubs, a second end opposite the first end, and one or more sidewalls disposed between the first end and the second end;

a shoulder strap engaged with the housing and structurally configured for placement on or around a shoulder of a user for carrying the golf bag; and a locking hinge establishing selectively pivotable engagement between the shoulder strap and the housing, the locking hinge comprising:

a slot engaged with the housing, the slot defining a first portion and a second portion; and a projection engaged with an end of the shoulder strap, the projection slidable within the slot between a first position when disposed within the first portion and a second position when disposed within the second portion, wherein, when the projection is in the first position, the strap is pivotable about a first axis relative to the housing, and wherein, when the projection is in the second position, the strap is mitigated from pivoting about the first axis.

2. The golf bag of claim 1, wherein, when the housing is placed on a substantially horizontal surface such that the shoulder strap opposes the substantially horizontal surface, weight of the shoulder strap provides a force that moves the projection within the slot from the first position to the second position.

3. The golf bag of claim 2, wherein, in an absence of other forces, the weight of the shoulder strap maintains the projection in the second position when the housing is placed on the substantially horizontal surface and the shoulder strap opposes the substantially horizontal surface.

4. The golf bag of claim 1, wherein, when the projection is in the second position, the shoulder strap bows away from the housing.

5. The golf bag of claim 1, wherein the slot is disposed on a rigid member engaged with a sidewall of the one or more sidewalls of the housing.

6. The golf bag of claim 1, wherein the first portion of the slot includes a larger diameter than the second portion of the slot.

7. The golf bag of claim 6, wherein the projection is sized and shaped such that it is prevented from rotating when disposed within the second portion of the slot, and wherein the projection is sized and shaped such that it can rotate when disposed within the first portion of the slot.

8. The golf bag of claim 1, wherein the locking hinge further comprises a folding hinge defining a second pivot point for the shoulder strap relative to the housing about a second axis intersecting the first axis, the folding hinge allowing pivoting of the shoulder strap about the second axis for movement of the shoulder strap toward the housing when the projection is in the first position, and the folding hinge mitigating pivoting of the shoulder strap about the second axis when the projection is in the second position.

9. The golf bag of claim 8, wherein, when the projection is in the first position, the folding hinge is disposed away from a rigid member containing the slot, and wherein, when the projection is in the second position, the folding hinge is disposed adjacent to the rigid member where the rigid member inhibits pivoting thereof.

10. The golf bag of claim 1, further comprising a hydration system including a reservoir disposed in the housing and a tube extending from the reservoir.

11. The golf bag of claim 10, wherein the tube traverses on or through at least a portion of the shoulder strap.

12. The golf bag of claim 11, wherein one or more of the tube and the shoulder strap includes a fixture structurally configured to couple the tube and the shoulder strap.

13. A method, comprising:

moving a projection disposed on an end of a shoulder strap of a bag from a first position to a second position relative to a slot engaged with the bag, wherein the projection is disposed within a first portion of the slot when in the first position, and wherein the projection is disposed within a second portion of the slot when in the second position;

preventing pivoting of the shoulder strap relative to the bag about a first axis when the projection is in the second position;

moving the projection from the second position to the first position such that the projection is disposed within the first portion of the slot; and permitting pivoting of the shoulder strap relative to the bag about the first axis when the projection is in the first position.

14. The method of claim 13, further comprising placing the bag on a substantially horizontal surface such that the shoulder strap opposes the substantially horizontal surface, wherein a weight of the shoulder strap causes the movement of the projection from the first position to the second position.

15. The method of claim 13, further comprising lifting the bag by the shoulder strap thereby causing the movement of the projection from the second position to the first position such that the projection is disposed within the first portion of the slot.

16. The method of claim 13, further comprising maintaining a position of the shoulder strap away from the bag when the projection is in the second position.

17. The method of claim 16, wherein preventing pivoting of the shoulder strap relative to the bag about the first axis when the projection is in the second position causes the shoulder strap to be bowed away from the bag.

18. The method of claim 13, further comprising preventing a pivoting of the shoulder strap relative to the bag about a second axis that intersects the first axis when the projection is in the second position.

19. The method of claim 13, further comprising permitting a pivoting of the shoulder strap relative to the bag about a second axis that intersects the first axis when the projection is in the first position.

20. The method of claim 19, wherein pivoting of the shoulder strap relative to the bag about the second axis moves the shoulder strap toward the bag thereby reducing a collective volume of the bag and the strap.

* * * * *